United States Patent [19]

Ejima et al.

[11] Patent Number: 4,840,846

[45] Date of Patent: Jun. 20, 1989

[54] HEAT-ADHESIVE COMPOSITE FIBERS AND METHOD FOR MAKING THE SAME

[75] Inventors: Shozo Ejima, Moriyama; Taizo Sugihara, Omihachiman; Morio Abe, Shiga, all of Japan

[73] Assignee: Chisso Corporation, Osaka, Japan

[21] Appl. No.: 94,891

[22] Filed: Sep. 10, 1987

[30] Foreign Application Priority Data

Sep. 12, 1986 [JP] Japan ..... 61-214145

[51] Int. Cl.[4] ..... D02G 3/00

[52] U.S. Cl. ..... 428/373; 428/370; 428/371; 428/374; 428/397; 428/399

[58] Field of Search ..... 428/373, 374, 370, 397, 428/399, 371; 264/171, 177.13

[56] References Cited

U.S. PATENT DOCUMENTS

| | | | |
|---|---|---|---|
| 3,509,013 | 4/1970 | Oppenlander | 428/373 |
| 3,760,052 | 9/1973 | Fukuma et al. | 264/171 |
| 3,900,678 | 8/1975 | Aishima et al. | 428/374 |
| 4,189,338 | 2/1980 | Ejima et al. | 264/171 X |
| 4,323,626 | 4/1982 | Kunimune et al. | 428/373 X |
| 4,469,540 | 9/1984 | Furakawa et al. | 264/171 X |

FOREIGN PATENT DOCUMENTS

| | | | |
|---|---|---|---|
| 1121314 | 7/1968 | United Kingdom | 264/171 |

*Primary Examiner*—Lorraine T. Kendell

*Attorney, Agent, or Firm*—Oblon, Spivak, McClelland, Maier & Neustadt

[57] ABSTRACT

A heat-adhesive composite fiber consisting of core portion and sheath portion, the core portion being of the side-by-side type composite structure comprising two core components of different polypropylene base polymers at a composite ratio of 1:2 to 2:1, one of the core components having a Q value, expressed in terms of the weight-average molecular weight/the number-average molecular weight, equal to or higher than 6 and the other having a Q value equal to or lower than 5, and the sheath portion meeting at least the requirements that it should comprise a sheath component of a polyethylene base polymer having a melting point lower by at least 20° C. than the lower one of the melting points of the two core components, and it should cover the core portion in a proportion of 25 to 55% by weight based on the total weight of it and the core portion.

7 Claims, 1 Drawing Sheet

HEAT-ADHESIVE COMPOSITE FIBERS AND METHOD FOR MAKING THE SAME

BACKGROUND OF THE INVENTION

1. Field of the Invention

The present invention relates to heat-adhesive composite fibers which may be processed by heating into a nonwoven fabric or the like to provide a bulky product with a soft touch or feeling, and a method for making the same fibers.

2. Statement of the Prior Art

Many years have elaspsed since there were known in the art the side-by-side type or sheath-core type polypropylene base heat-adhesive composite fibers, which comprise two components having different melting points, and have a considerable portion, e.g., one half or more portion of their surfaces occupied by the component having a lower melting point. In the meantime, various improvements have been achieved. In the main, such improvements have aimed to improving the shrink properties of a web in processing the fibers into a nonwoven fabric by heating and enhance the strength, bulkiness and like factors of the resulting nonwoven fabric, and appreciable outcomes have been attained, but in terms of the bulkiness of the product the outcomes have not yet been satisfactory.

Hitherto, any appreciable outcome has not been attained in terms of not only the bulkiness but also the touch or feeling of nonwoven fabrics obtained from the polypropylene base heat-adhesive composite fibers by heating. Improvements in touch or feeling have been attempted as by using fine deniers or increasing the proportion of other fibers to be mixed with the composite fibers, such as rayon or wool, but have not still resulted in any product excelling in softness and bulkiness. The sitiuation being like this, a strong demand for further improvements in the bulkiness and softness of nonwoven fabrics intended for purposes such as paper diapers or sanitary materials is not satisfied. Thus, it is strongly desired to meet such a demand.

SUMMARY OF THE INVENTION

A main object of the present invention is to provide heat-adhesive composite fibers which can solve the aforesaid problems, and can easily be processed by heating into a nonwoven fabric with their heat adhesiveness, said nonwoven fabric being not only bulky but also having a highly soft touch or feeling.

As a result of intensive and extensive studies made to attain the object, it has been found that the nonwoven fabric structure is extremely stabilized and sufficiently bulked and have soft touch or feeling when the composite fibers processed into the nonwoven fabrics are constructed by a core portion which imparts bulkiness to the nonwoven fabrics and a sheath portion which imparts heat adhesiveness to the fiber, and furthermore, in addition to the above-mentioned construction, when a number of nodular aggregates consisting of the sheath component are formed on the surfaces of the fibers except for the portions of the fibers bonded together, the soft touch or feeling is further elevated.

According to one (or the first) aspect of the present invention, there is provided a heat-adhesive composite fiber comprising a core portion and a sheath portion, said core portion being of the side-by-side type composite structure comprising two core components of different polypropylene base polymers in a composite ratio of 1:2 to 2:1, one of said core components having a Q value, expressed in terms of the weight-average molecular weight/the number-average molecular weight, equal to or higher than 6 and the other having a Q value equal to or lower than 5, and said sheath portion meeting at least the requirements (hereinafter referred to as the sheath requirements) that it should comprise a sheath component of a polyethylene base polymer having a melting point lower by at least 20° C. than the lower of the two melting points of said two core components, and it should cover completely said core portion in a proportion of 25 to 55% by weight based on the total weight of it and said core portion.

According to another (or the second) aspect of the present invention, there is provided a method for making heat-adhesive composite fibers by separately subjecting to composite-spinning two polypropylene base polymers for two core components and a polyethylene base polymer for a sheath component, which has a melting point lower by at least 20° C. than the lower one of the melting points of said two polypropylene base polymers, thereby obtaining a composite nonstretched yarn of the structure that a core portion of the side-by-side type composite structure consisting of two core components in a composite ratio of 1:2 to 2:1, one of said core components having a Q value, expressed in terms of the weight-average molecular weight/the number-average molecular weight, equal to or higher than 6 and the other having a Q value equal to or lower than 5, is completely covered with a sheath portion comprising said sheath component in a weight proportion of 25 to 55% by weight based on the total weight of it and said core portion, and stretching said composite nonstretched yarn by one- or more-stage stretching process.

BRIEF DESCRIPTION OF THE FIGURES

The first aspect of the present invention will now be concretely explained with reference to the accompanying drawings, in which.

DETAILED DESCRIPTION OF THE PREFERRED EMBODIMENTS

EXPLANATION OF THE FIRST ASPECT OF THE INVENTION

Figure 1:
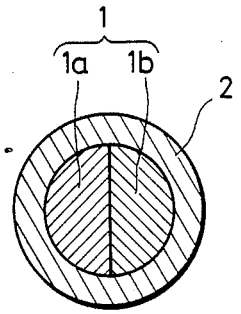
FIGS. 1, 2 and 3 each are a schematical section showing the sectional structure of the heat-adhesive composite fiber according to the present invention.
Figure 2:
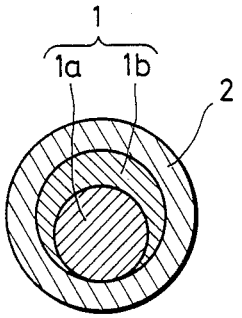
Figure 3:
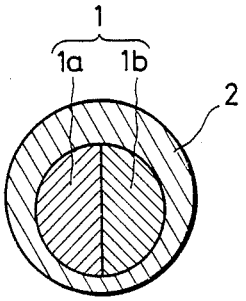

Referring to the drawings, reference numeral 1 is a core portion (hereinafter simply referred to as the core) of the side-by-side type composite structure comprising core-dividing zones 1*a* and 1*b* each consisting of a core component of a different polypropylene base polymer. The side-by-side type composite structure of the core 1 may take on various forms. For instance, the core 1 may be of the sectional structure which is diametrically divided into two identical demi-circles, as illustrated in FIG. 1. Alternatively, the core 1 may be of the sectional structure in which one core-dividing zone 1*a* is mostly surrounded with the other core-dividing zone 1*b*, except for its slight peripheral portion, as illustrated in FIG. 2. In most cases, the core actually assumes a structure lying between the aforesaid extreme structures. Still alternatively, the core 1 may be located off the center in section of the fiber, as illustrated in FIG. 3.

Polypropylene based polymers, which are represented by crystalline polypropylene, may include copolymers of propylene with a small amount of other alpha-olefins save propylene, such as ethylene, butene-1 pentene-1. In this case, it is preferred that the comonomer component content is up to 40% by weight.

Such polypropylene base polymers are used as the core components of the respective core-dividing zones 1*a* and 1*b*, and are different from each other in the Q value that is a numerical value expressing the molecular weigtht distribution of polymers and calculated from the following equation:

$$Q=Mw/Mn$$

wherein Mw stands for the weight-average molecular weight, and Mn indicates the number-average molecular weight. The core component of one core-dividing zone 1*a* (which may hereinafter be simply referred to as the component 1*a*) has a Q value of at least 6, and to the component 1*a* the general-purpose polypropylene is applied, while the core component of the other core-dividing zone 1*b* (which may hereinafter be referred to as the component 1*b*) has a Q value of up to 5, preferably 3 to 5.

The composite ratio of the core components 1*a* and 1*b* forming the core 1 is in a range of 1:2 to 2:1.

Thus, the side-by-side type composite structure of the core comprising the components 1*a* and 1*b* having different Q values imparts to the composite fibers the crimps revealed after fiber-manufacturing process and in addition the crimps developed in processing from latent crimps by heating, resulting in an increase in bulkiness.

Reference numeral 2 is a sheath portion (hereinafter simply called the sheath) which is formed of a sheath component of a polyethylene base polymer, the melting point of which is lower by at least 20° C. than the lower one of the melting points of the two core components of the core 1, viz., the components 1*a* and 1*b* (or the melting point common to the components 1*a* and 1*b*, if there is no difference in the melting point therebetween). Such polyethylene base polymer may include polyethylene or a copolymer of ethylene/vinyl acetate, having an ethylene content of 98 to 60% by weight. That polyethylene is exemplified by a low-, intermediate- or high-density polyethylene.

The sheath-core type composite fibers of the present invention are constituted by covering the core 1 with the sheath 2 in such a manner that the proportion of the sheath 2 is in a range of 25 to 55% by weight based on the total weight of it and the core 1. When the proportion of the sheath 2 is below 25% by weight, the strength of the resulting nonwoven fabric decreases to such a low level that some practically problems arise. In a proportion of the sheath 2 exceeding 55% by weight, on the other hand, the development of crimps due to the core 1 is inhibited so that the composite fibers are insufficiently crimped and the resulting nonwoven fabrics are inferior in bulkiness.

As described above, the sheath 2 is made of polyethylene base polymer having a particular low, melting point, thus the adhesion portion between fibers can be formed by heat treatment as in the case of the conventional heat-adhesive composite fiber.

Figure 4:
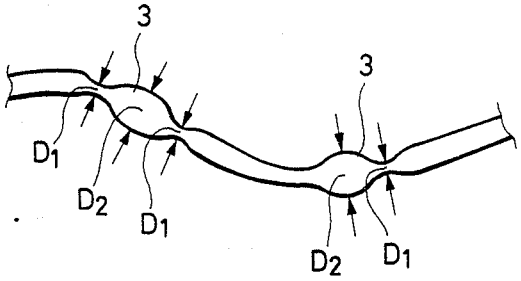
FIG. 4 is a sketch depicting the sheath portion on which nodular agglomerates are formed.

As long as the sheath 2 meets the aforesaid sheath requirement that it be of the above-mentioned structure, a ninwoven fabric product obtained from the heat-adhesive composite fibers constituted by it together with the core 1 may have a sufficient bulkiness and shown an excellent touch or feeling. However, the following structure may impart a much softer touch or feeling to the nonwoven fabric product. More specifically, the structure is that there are many portions on the sheath 2 which form a number of nodular aggregates 3 consisting of the sheath component by a heat treatment at a temperature between the melting point of the sheath component and the lower one of the melting points of the two core components 1*a* and 1*b* (the portions may hereinafter be called the aggregatable portions). In the aggregetable portions, the sheath 2 is released from the core 1, or is latently released from the core 1 due to their feeble interface affinity. The aggregatable portions are distinguishable from the other portion, depending upon whether or not the nodular aggregates 3 consisting of the sheath component are formed by the heat treatment at the aforesaid temperature, as illustrated in FIG. 4. In most cases, a diameter ($D_2$) of the greatest portion of the nodular aggregate 3 is about two times the diameter ($D_1$) of the thinnest portion adjancent thereto. Per one centimeter of the actual length of fiber, there are formed 0.1 to 0.5 nodular aggregates 3 having such a diameter ($D_2$). When the proportion of the sheath 2 exceeds 55% by weight of the total weight of it and the core 1, the formation of the aggregates 3 is not sufficient and, hence, makes no contribution to improvements in the touch or feeling of nonwoven fabrics. Although no special limitation is imposed upon the fineness of fibers, 1.5 to 7 denniers are suitable in applications in which weight is given to toch or feeling. More suitable is a range of a finer value of 0.7 to 7 deniers.

The heat-adhesive composite fibers according to the present invention are constructed as mentioned above.

Explanation of the Second Aspect of the Invention

For the production of the heat-adhesive composite fibers according to the present invention, provided are three polymers, i.e., two polypropylene base polymers for the core components and one polyethylene base polymer for the sheath component, as already mentioned in connection with the first aspect of the present invention. Referring to the polypropylene base polymers for the core components, the polypropylene base polymer for the component 1*a* having a Q value of at least 6 should preferably show a melt flow rate (hereinafter sometimes abbreviated as MFR and measured according to Table 1, Condition 14 provided by JIS K 7210) of 4 to 40, and the polypropylene base polymer for the component 1b Q value of 5 or less should preferably show a melt flow rate of 4 to 60. Polypropylele base polymers having a Q value of 5 or less may be prepared by the following methods, using polypropylene base polymers having a Q value of more than 5 as the starting material. According to one method, added to and mixed with the starting polymer is an organic peroxide compound in an amount of 0.01% by weight based on the starting polymer, said organic peroxide compound releases oxygen by heating at a temperature equal to or higher than the melting point of the starting polymer, such as t-butyl hydroperoxide, cumene hydroperoxide or 2,5-dimethylhexane-2,5-dihydroperoxide etc., and the resulting mixture is subjected to melting extrusion from an extruder for granulation. According to another method, the starting polymer may be subjected to melting extrusion several times at elevated temperatures, with no addition of the aforesaid organic peroxide compound, for repeated granulation. Since the Q value is decreased a little by melting extrusion, the polymer for the component 1*a* before melting spinning should preferably have a Q value of slightly higher than 6, while the polymer for the component 1*b* may have a Q value of slightly higher than 5. The polyethylene base polymer should preferably have a melt index (hereinafter sometimes abbrebiated as MI and measured according to Table 1, Condition 4 provided by JIS K 7210) of 2 to 50.

After the aforesaid three polymers have been provided, they are separately supplied to the respective three extruders for melting extrusion, and the obtained molten polymers are guided to a known appropriate composite spinning nozzle by way of the respective gear pumps. For instance, such a spinning nozzle as disclosed in Japanease Patent Publication No. 44-29522 may be used as the known composite spinning nozzle capable capable of spinning out three polymer components into a sectional structure similar to that of the heat-adhesive composite fiber according to the present invention. When the aforesaid three polymers are guided to such a spinning nozzle, the outputs of the respective gear pumps are regulated in such a manner that the ratio of the amounts of the polymers for the core components 1*a* and 1*b* is a given composite ratio within the range of 2:1 to 1:2, and the amount of the polymer for the sheath component is a given one within the range of 25 to 55% by weight based on the total amount of it and the core components.

The thus obtained, nonstretched compsite yarns of the given sectional shape are stretched in a single or multi-stage manner. To increase the latent crimping properties of the obtained composite yarns, it is generally prefered that the multi-stage stretching be carried out under the condition that the first-stage stretching temperature is lower than the second-stage stretching temperature, and that the single-stage stretching be effected at normal temperature (15° to 40° C.) or a relatively low temperature close thereto. Since stretching is usually accompanied by the generation of heat, the single-stage stretching or the first-stage stretching of the multi-stage stretching is preferably carried out while passing the yarns through the water maintained at normal temperature, or in a room maintained at normal temperature by cooling water.

The stretching conditions vary somewhat depending upon the heat-adhesive composite fibers to be produced.

If it is intended to produce the heat-adhesive composite fibers meeting only the aforesaid sheath requirements imposed upon the sheath 2, the stretching temperature may then be within a range of normal temperature (15° to 40°C.) to 130° C. The draw ratio is within a range of 1.3 to 9, preferably 1.5 to 6, as expressed in terms of the overall draw ratio. Especially, the following stretching condition is very preferable, that is, the stretching temperature of a normal temperature with the draw ratio within a range of 4 to 5 at the first-stage stretching, and the stretching temperature within a range of 70° to 90° C. with the draw ratio within a range of 0.8 to 0.9 at the second-stage stretching.

If it is intended to produce the heat-adhesive composite fibers meeting the said sheath requirements and further having the aforesaid aggregatable portions on the sheath 2, stretching has to be effected by somewhat complicated steps as mentioned below. Prior to stretching the composite nonstretched yarns are firstly heat-treated under no tension at a temperature ranging from 80° C. to below the melting point of the sheath component for 10 seconds or longer, preferably for 12 to 180 seconds. This heat treatment promotes the crystallization of the two core components 1*a* and 1*b*, and decreases the interface affinity of the sheath 2 with respect to the core 1. For the heat treatment, for instance, the yarns may be continuously passed through a dry heat oven or hot water, or batchwise treated in a large dryer. The heat-treated nonstretched yarns are cooled down to normal temperature (15° to 40° C.,) and the first-stage stretching is then carried out at that normal temperature in a draw ratio of 1.3 to 2, preferably 1.5 to 1.8. Synergistically combined with the said heat treatment occurring prior to stretching, the first-stage stretching promotes a reduction in the interface affinity between the sheath 2 and the core 1. In consequence, the sheath 2 is actually or latently released from the core 1 at their interface to produce a number of the aggregatable proportions. A draw ratio exceeding 2 at the first-stretching stage offers problems such as fuzzing, a drop in fiber strength and an increase in the degree of shrinkage of the resulting nonwoven fabric, whilst a draw ratio of less than 1.3 renders it difficult to obtain the effect as contemplated in the present invention. Subsequently following the first-stage stretching, the second-stage streching is carried out, without relaxing the yarn between the first-stage and second-stage stretching, at a temperature of 80° C. or higher and below the melting point of the sheath component. In this case, the draw ratio should be equal to or higher than 90% of the maximum draw ratio (at which the yarn drawn in the first-stage stretching begins to snap off by increasing the draw ratio gradually in the second-stage stretching). As the fibers are stretched at the second stage without letting the fibers loose after the first-stage stretching, as mentioned above, it is possible to prevent the fibers from being entangled together due to the crimps to be developed by fiber releasing and snapping off by the second-stage stretching. In addition, the second-stage stretching carried out at the temperature and draw ratio, as mentioned above, gives rise the three-dimensional crimping, by which the fiber strength is increased, the degree of shrinkage and bulkiness of the resulting nonwoven fabric are decreased and increased, respectively, and the formation of the aforesaid aggregatable portions is further promoted.

In case of producing the heat-adhesive composite fibers meeting the aforesaid sheath requirements and further having the aggregatable portions, its touch or feeling is then made by far softer, if the nonstretched yarns prepared in the following manner are used. That is, when composite spinning is carried out with three polymers, a chemical agent for reducing the interface affinity (which may hereinafter be called the affinity-reducing agent) is added to these polymers. More exactly, the affinity-reducing agent is added to both polypropylene base polymers for the two core components, or to the polyethylene base polymer for the sheath component, or to both polymers for two core components and the sheath component. As such affinity-reducing agents, effective use is made of polysiloxanes such as polydimethylsiloxane, phenyl-modified polysiloxane, amino-modified polysiloxane, olefin-modified polysiloxane, hydroxide-modified polysiloxane and epoxy-modified polysiloxane, and fluorine compounds such as perfluroloalkyl group-containing polymers, perfluoroalkylene group-containing polymers and modified products of these polymers. The affinity-reducing agent is added to each pertinent polymer in an amount of 0.05 to 1.0% by weight based thereon. Thus, if stretching is applied to nonstretched yarns obtained by composite spinning with adding the affinity-reducing agent at least either one of the polymers for the core and sheath components, the heat-adhesive composite fibers can then be made, while further promoting the formation of the aggregatable portions.

After the composite nonstretched yarns have been stretched by the single- or multi-stage stretching, the stretched yarns are dried, as the occasion may be, and may immediately be used, or may be cut to a given length for the purpose intended.

In view of efficiency, the treatments of nonstretched yarns such as heating, cooling and stretching after spinning should preferably be carried out usually with nonstretched yarn bundles formed into a tow of several ten thousand to several million deniers. It is also preferred that such a tow is subjected to the given treatments such as heating, cooling and stretching, while passing it continuously therethrough or moving it therethrough at a low speed in an assembled state, without cutting-off of said tow to short fibers, if possible. The treatments such as heating may be carried out in a batchwise manner, as already mentioned.

The heat-adhesive composite fibers according to the present invention are obtained by carrying out the second aspect of the present invention, as mentioned above.

Effects

The heat-adhesive composite fibers according to the present invention are of the composite structure wherein the core of the side-by-side type composite structure, for which two polypropylene base polymer having different Q values are used, is covered with the sheath of the polyethylene base polymer having a melting point lower than those of the polymers forming the core components. Accordingly, although the heat-adhesive composite fibers according to the present invention are of the sheath-core structure which is generally recognized to show a reduced or limited development of crimps, the revealed crimps and latent crimps developed by heating are very large and take on a moderate three-dimensional shape, due to the core being of side-by-side structure. And on account of the sheath-core structure of whole section of the composite fiber, the composite fiber possesses sufficient heat adhesiveness of the sheath which makes it easy to prepare bulky nonwoven fabrics of large bulk and stabilized structure by heating. In addition, when the sheath additionally includes many aggregatable portions, such portions are molten and aggregated by heating on the fiber surfaces, and are then solidified to give a number of nodular aggregates 3 consisting of the sheath component, which imparts high softness to the touch or feeling of nonwoven fabrics. The reasons appear to be that the area of contact of the fiber surfaces is reduced to a remarkable degree, since the nodular aggregate 3 come into point contact with the surface of the adjacent fibers.

Accordingly, the heat-adhesive composite fibers according to the present invention further improve the buldiness and touch or feeling of nonwoven fabrics obtained therefrom, which have been problems in the prior art.

Examples and Comparative Examples

In what follows, the present invention will be explained in further detail with reference to the examples and comparative examples.

Examples 1 to 12 & Comparative Examples 1 to 5

Eight polypropylenes a, b, c, d, e, f, g and h and two polyethylene base polymers i and j set forth in Table 1 were used in the combinations set forth in Table 2. The composite fibers of the structure, wherein the cores of the side-by-side type composite structure constructed from the core component 1*a* and 1*b* of two polypropylenes were covered with the sheathes formed of one polyethylene base polymer were prepared by the following composite spinning, heating and stretching treatments.

The spinning nozzle used had 120 holes each of 1.0 mm in diameter. The components 1*a* and 1*b* forming the core were used in a composite ratio of 1:1, whilst the proportion of the sheath to the total amount of the core plus sheath was varied in a range of 33.3 to 66.7% by weight. Referring to the spinning temperature (the polymer temperature just to spinning out from the spinning nozzle), the polypropylenes for both components 1*a* and 1*b* and the polyethylene base polymer were spinned at 260° C. and 220° C., respectively. In this manner, composite nonstretched yarns of 11 d/f (deniers per filament) were obtained. The composite nonstretched yarns were bundled into a tow of about 90,000 deniers, and were stretched. For stretching, three-stage rolls were used. The single-stage stretching was carried out by passing the tow through the first and second stretchinbg rolls, whilst the double-stage stretching was done by passing the tow through the third stretching roll following the same first-stage stretching as the above-mentioned single stage stretching. Referring to the stretching temperatures, the first-stage stretching temperature (identical with the stretching temperature in the case of the single-stage stretching is defined as being identical with the temperature of the first stretching roll, whilst the second-stage stretching temperature is defined as being identical with the temperature of the second stretching roll. In this manner, the tow was passed through a bath containing 0.2% of a surface finishing agent at 21° C., and was successively passed through the first stretching roll of 26° C., the second stretching roll of 80° C., and the third stretching roll of 28° C. for double-stage stretching (Examples 1 to 9, Comparative examples 1 to 5), or was passed through the second stretching roll of 70° C. after the first stretching roll without using the second stretching roll for single-stage stretching. Afterwards, the products of a temperature higher than room temperature were cooled down to room temperature. The strength and elongation of the thus obtained respective heat-adhesive composite fibers was measured, whilst the shape of crimps thereof was observed. Further, each heat-adhesive composite fiber was used in amount of 100% and heated into a nonwoven fabric, the bulkiness of which was then tested.

The procedures of these tests are given below.

Fiber Strength and Elongation:

JIS L 1015 7.7

Crimp Shape:

After heating at 145° C. for 5 minutes, visual estimation was made of whether each fiber was three-dimensionally or two-dimensionally crimped.

Bulkiness of Nonwoven Fabric:

A group of fibers are passed twich through a carding machine to make a web of 100 g/m$^2$, from which five 25 cm×25 cm square web pieces were cut. Each web piece was put between craft paper sheets, and the assembly was placed in a hot-air circulation type dryer of 145° C. for 5 minutes to make a nonwoven fabric, which was in turn cooled at room temperature.

Each nonwoven fabric was cut into 20 cm×20 cm pieces. Such five pieces were formed into a stack on which a cardboard was placed, and the thickness of one nonwoven fabric was calculated from the overall thichness of the stack to find the value in mm for bulkiness.

The results are set forth in Table 2.

TABLE 1

| | Polymer | Melting Point (°C.) | Flowability | Q valve |
|---|---|---|---|---|
| a | Polypropylene | 162 | MFR 8 | 7.4 |
| b | Polypropylene | 162 | MFR 10.2 | 6.6 |

TABLE 1-continued

| | Polymer | Melting Point (°C.) | Flowability | Q valve |
|---|---|---|---|---|
| c | Polypropylene* | 162 | MFR 10.0 | 5.7 |
| d | Polypropylene* | 162 | MFR 12.2 | 4.5 |
| e | Polypropylene* | 162 | MFR 14.0 | 5.4 |
| f | Polypropylene* | 162 | MFR 22.0 | 4.9 |
| g | Polypropylene* | 162 | MFR 32.5 | 4.5 |
| h | Polypropylene* | 162 | MFR 34.0 | 3.6 |
| i | High-Density Polyethylene | 128 | MI 19 | — |
| j | Mixed polymer of 85 wt. % of high-density polyethylene (MP:128° C. 3, MI:19) with 15 wt. % of ethylene/vinyl acetate copolymer (ethylene content:80%, MP:94° C., and MI:20) | 127 | MI 19.4 | — |

*Each starting polypropylene was modified by adding thereto 2,5-dimethyl-2,5-di(tertiary-butyloxy)hexane and extruding the product out of an extruder for granulation. The starting polypropylenes c, d, e, f and h had MFRs of 6, 4, 6, 18 and 4, respectively.

TABLE 2

| | Polymer: For core components 1a | Polymer: For core components 1b | Polymer: For sheath component | Proportion of sheath (wt. %) | Q value of core components after spinning 1a | Q value of core components after spinning 1b | Flowability after spinning: Core components (MFR) 1a | Flowability after spinning: Core components (MFR) 1b | Flowability after spinning: Sheath component (MI) |
|---|---|---|---|---|---|---|---|---|---|
| Comparative Example 1 | a | b | i | 33.3 | 7.2 | 6.0 | 12.0 | 18.1 | 22.2 |
| Comparative Example 2 | a | c | i | 33.3 | 7.2 | 5.3 | 12.2 | 16.2 | 22.0 |
| Comparative Example 3 | b | c | i | 33.3 | 6.1 | 5.3 | 17.0 | 16.4 | 22.1 |
| Comparative Example 4 | b | c | i | 33.3 | 6.1 | 5.3 | 17.0 | 16.4 | 22.1 |
| Example 1 | a | e | i | 33.3 | 7.2 | 5.0 | 12.1 | 21.2 | 22.0 |
| Example 2 | a | f | i | 33.3 | 7.2 | 4.3 | 12.1 | 29.0 | 22.1 |
| Example 3 | a | g | i | 33.3 | 7.2 | 3.9 | 12.2 | 41.1 | 22.2 |
| Example 4 | a | h | i | 33.3 | 7.2 | 3.2 | 12.0 | 46.3 | 22.0 |
| Example 5 | b | d | i | 33.3 | 6.1 | 4.2 | 17.2 | 18.4 | 22.1 |
| Example 6 | b | g | i | 33.3 | 6.1 | 3.9 | 17.0 | 41.2 | 22.1 |
| Example 7 | b | g | i | 45 | 6.1 | 3.9 | 17.0 | 41.2 | 22.1 |
| Example 8 | b | g | i | 55 | 6.1 | 3.9 | 17.0 | 41.2 | 22.1 |
| Comparative Example 5 | b | g | i | 66.7 | 6.1 | 3.9 | 17.0 | 41.2 | 22.1 |
| Example 9 | b | g | j | 33.3 | 6.1 | 3.9 | 17.0 | 41.2 | 25.0 |
| Example 10 | b | g | i | 33.3 | 6.1 | 3.9 | 17.0 | 41.2 | 22.1 |
| Example 11 | b | g | i | 45 | 6.1 | 3.9 | 17.0 | 41.2 | 22.1 |
| Example 12 | a | h | i | 33.3 | 7.2 | 3.2 | 12.0 | 46.3 | 22.0 |

| | Stretching Temperature (C.°): 1st Stage | Stretching Temperature (C.°): 2nd Stage | Draw ratio: 1st Stage | Draw ratio: 2nd Stage | Draw ratio: Overall | Strength and elongation of fiber: g/d | Strength and elongation of fiber: % | Crimp shape | Bulkiness of nonwoven fabric (mm) |
|---|---|---|---|---|---|---|---|---|---|
| Comparative Example 1 | 26 | 80 | 4.4 | 0.87 | 3.83 | 3.7 | 44 | Two-dimensional | 3.6 |
| Comparative Example 2 | 26 | 80 | 4.4 | 0.87 | 3.83 | 3.7 | 43 | Two-dimensional | 3.6 |
| Comparative Example 3 | 26 | 80 | 4.4 | 0.87 | 3.83 | 3.8 | 48 | Two-dimensional | 4.3 |
| Comparative Example 4 | 26 | 80 | 4.4 | 0.87 | 3.83 | 3.7 | 45 | Two-dimensional | 4.6 |
| Example 1 | 26 | 80 | 4.4 | 0.87 | 3.83 | 3.9 | 45 | Three-dimensional | 7.7 |
| Example 2 | 26 | 80 | 4.4 | 0.87 | 3.83 | 3.9 | 52 | Three-dimensional | 7.8 |
| Example 3 | 26 | 80 | 4.4 | 0.87 | 3.83 | 3.9 | 51 | Three-dimensional | 8.0 |
| Example 4 | 26 | 80 | 4.4 | 0.87 | 3.83 | 3.7 | 58 | Three-dimensional | 7.9 |
| Example 5 | 26 | 80 | 4.4 | 0.87 | 3.83 | 3.6 | 57 | Three-dimensional | 7.2 |
| Example 6 | 26 | 80 | 4.4 | 0.87 | 3.83 | 3.7 | 50 | Three-dimensional | 6.4 |
| Example 7 | 26 | 80 | 4.4 | 0.87 | 3.83 | 3.9 | 61 | Three- | 6.9 |

TABLE 2-continued

| | | | | | | | | | |
|---|---|---|---|---|---|---|---|---|---|
| | | | | | | | | dimensional | |
| Example 8 | 26 | 80 | 4.4 | 0.87 | 3.83 | 3.6 | 60 | Three-dimensional | 6.8 |
| Comparative Example 5 | 26 | 80 | 4.4 | 0.87 | 3.83 | 3.5 | 63 | Two-dimensional | 5.1 |
| Example 9 | 26 | 80 | 4.4 | 0.87 | 3.83 | 3.7 | 46 | Three-dimensional | 7.5 |
| Example 10 | 26 | — | 4.2 | — | 4.2 | 3.6 | 48 | Three-dimensional | 7.7 |
| Example 11 | 26 | — | 4.2 | — | 4.2 | 3.6 | 48 | Three-dimensional | 7.5 |
| Example 12 | 26 | — | 4.2 | — | 4.2 | 3.5 | 62 | Three-dimensional | 7.8 |

From Examples 1 to 12 and Comparative Examples 1 to 4 specified in Table 2, it is found that when the two core components have the Q values within the range defined by the present invention, the development of three-dimensional crimps are considerably noticable and the bulkiness of the obtained nonwoven fabrics are excellent, if other requirements satisfy the present invention. From the çomparison of Examples 6 to 12 and Comparative Example 5, it is found that the composite fibers obtained by the present method are excellent in all the properties including the development of three-dimensional crimps and the bulkiness of the obtained nonwoven fabrics; however, when the proportion of the sheath departs from the presently defined range, the composite fibers are poor in the aforesaid properties irrespective of whether the starting polymers are identical with or different from those used in the examples of the present invention. It is also noted that even when the single-stage stretching is applied, the present method provides the composite fibers which can be processed to nonwoven fabrics of very excellent bulkiness.

Examples 13 to 22 & Comparative Examples 6 to 16

Same polymers as those used in Examples 1 to 12 and Comparison Examples 1 to 5 were used in accordance with the procedures similar to those mentioned in connection therewith to obtain the nonstretched yarns of composite fibers comprising various combinations as set forth in Table 3. In Example 15, however, 0.10% by weight of dimethylpolysiloxane was mixed with high-density polyethylene i. The composite nonstretched yarns were bundled into a tow of about 90,000 deniers, which was successively treated in the following manner. First of all, the tow was heated by passing it under no tension through a dry heat chamber of 105° C. for 30 seconds. (However, any heat treatment was not applied in Comparative Examples 6, 7, 8, 15 and Example 19.) Thereafter, the tow was allowed to stand in a tow can to completely cool it down to room temperature (22° C.). Then, the tow was passed through a bath of 21° C. containing 0.2% of a surface finishing agent, and was subjected to the first-stage stretching between a pair of cold stretching rolls of 26° C. (but of 60° C. in Comparative Example 12 and of 90° C. in Comparative Examples 14 and 15) at a draw ratio of 1.6. The tow stretched at first-stage was transferred successively to the subsequent second-stage stretching process without letting it loose, and the tow was stretched between a pair of stretching rolls heated at 90° C. (but at different temperatures in Comparative Examples 10, 11 and 12) at the draw ratios corresponing to various per cents of various maximum draw ratios in the second-stage stretching, as specified in Table 3, ans was thereafter cooled down to room temperature. The strength and elongation of each of the thus obtained heat-adhesive composite fibers were measured, whilst the shape of crimps and the degree of the aggregatability of the sheath were observed. Further, each heat-adhesive composite fiber was used in the amount of 100% and heated into a nonwoven favric, the bulkiness and touch or feeling of which were then tested.

The procedures of these tests, save the tests already explained, are shown below.

Degree of Aggregatability:

After heating the composite fibers at 145° C. for 5 minutes, 100 fibers each of about 3 to 12 cm in length were observed under an optical microscope. Estimation was made in terms of the following reference numerals 1, 2, 3 and 4, based on an average number of the nodular aggregates per one centimeter of actual fiber length, which had a maximum portion having a diamerter at least two times as large as the minimum diameter of the thinner portion adjacent to the nodular aggregate.

1: 0.30 or more
2: 0.10 to 0.29
3: 0.01 to 0.09
4: below 0.01

Touch or Feeling of Nonwoven Fabric

The touch or feeling of the nonwoven fabrics obtained in accordance with the procedures mentioned in connection with "Bulkiness of Nonwoven Fabric" was examined by a five-man panel, while comparing with that of the reference nonwoven fabric. Estimation was made by majority in terms of the following numerals.

1: Softness was very good
2: Softness was considerably good
3: Softness was substantially identical
4: Softness was hard and poor The aforesaid reference nonwoven fabric for the estimation of touch or feeling was obtained from the composite fibers of Comparative Example 15 wherein the nonstretched yarn was stretched substantially according to the prior art.

The results are shown in Table 3.

TABLE 3

| Polymer for Core Components | Polymer for | Proportion of Sheath | Q value of Core Components After Spinning | Flowability After Spinning: Core Components (MFR) | Flowability After Spinning: Sheath Component | Stretching Temperature 1st | Stretching Temperature 2nd |
|---|---|---|---|---|---|---|---|

TABLE 3-continued

| | 1a | 1b | Sheath Component | (wt. %) | 1a | 1b | 1a | 1b | (MI) | Stage | Stage |
|---|---|---|---|---|---|---|---|---|---|---|---|
| Comparative Example 6* | a | b | i | 33.3 | 7.2 | 6.0 | 12.0 | 18.1 | 22.2 | 26 | 90 |
| Comparative Example 7* | a | c | i | 33.3 | 7.2 | 5.3 | 12.2 | 16.2 | 22.0 | 26 | 90 |
| Comparative Example 8* | b | c | i | 33.3 | 6.1 | 5.3 | 17.0 | 16.4 | 22.1 | 26 | 90 |
| Comparative Example 9 | b | c | i | 33.3 | 6.1 | 5.3 | 17.0 | 16.4 | 22.1 | 26 | 90 |
| Example 13 | a | e | i | 33.3 | 7.2 | 5.0 | 12.1 | 21.2 | 22.0 | 26 | 90 |
| Example 14 | a | e | i** | 33.3 | 7.2 | 5.0 | 12.0 | 21.0 | 22.3 | 26 | 90 |
| Example 15 | a | f | i | 33.3 | 7.2 | 4.3 | 12.1 | 29.0 | 22.1 | 26 | 90 |
| Example 16 | a | g | i | 33.3 | 7.2 | 3.9 | 12.2 | 41.1 | 22.2 | 26 | 90 |
| Example 17 | a | h | i | 33.3 | 7.2 | 3.2 | 12.0 | 46.3 | 22.0 | 26 | 90 |
| Example 18 | b | d | i | 33.3 | 6.1 | 4.2 | 17.2 | 18.4 | 22.1 | 26 | 90 |
| Comparative Example 10 | b | g | i | 33.3 | 6.1 | 3.9 | 17.0 | 41.2 | 22.1 | 26 | 26 |
| Comparative Example 11 | b | g | i | 33.3 | 6.1 | 3.9 | 17.0 | 41.2 | 22.1 | 26 | 70 |
| Comparative Example 12 | b | g | i | 33.3 | 6.1 | 3.9 | 17.3 | 41.0 | 22.1 | 60 | 70 |
| Comparative Example 13 | b | g | i | 33.3 | 6.1 | 3.9 | 17.0 | 41.2 | 22.1 | 26 | 90 |
| Comparative Example 14 | b | g | i | 33.3 | 6.1 | 3.9 | 17.0 | 41.2 | 22.1 | 90 | 90 |
| Comparative Example 15* | b | g | i | 33.3 | 6.1 | 3.9 | 17.0 | 41.2 | 22.1 | 90 | 90 |
| Example 19* | b | g | i | 33.3 | 6.1 | 3.9 | 17.0 | 41.2 | 22.1 | 26 | 90 |
| Example 20 | b | g | i | 45 | 6.1 | 3.9 | 17.0 | 41.2 | 22.1 | 26 | 90 |
| Example 21 | b | g | i | 55 | 6.1 | 3.9 | 17.0 | 41.2 | 22.1 | 26 | 90 |
| Comparative Example 16 | b | g | i | 66.7 | 6.1 | 3.9 | 17.0 | 41.2 | 22.1 | 26 | 90 |
| Example 22 | b | g | j | 33.3 | 6.1 | 3.9 | 17.0 | 41.2 | 25.0 | 26 | 90 |

| | Draw Ratio | | Maximum Draw Ratio in Second-Stage | A/B × | Strength and Elongation of Yarn | | | Degree of Aggregata- | Bulkiness of Nonwoven | Touch or Feeling of Nonwoven |
|---|---|---|---|---|---|---|---|---|---|---|
| | 1st Stage | 2nd Stage (A) | Stretching (B) | 100 (%) | g/d | % | Crip Shape | bility | Fabric (mm) | Fabric |
| Comparative Example 6* | 1.6 | 2.8 | 3.0 | 93 | 3.9 | 42 | Two-Dimensional | 4 | 3.5 | 4 |
| Comparative Example 7* | 1.6 | 2.7 | 2.9 | 93 | 3.9 | 40 | Two-Dimensional | 4 | 3.5 | 4 |
| Comparative Example 8* | 1.6 | 2.8 | 3.0 | 93 | 4.0 | 46 | Two-Dimensional | 4 | 4.5 | 4 |
| Comparative Example 9 | 1.6 | 2.6 | 2.8 | 93 | 3.9 | 42 | Two-Dimensional | 3 | 4.6 | 3 |
| Example 13 | 1.6 | 2.9 | 3.2 | 91 | 4.2 | 40 | Three-Dimensional | 2 | 7.7 | 2 |
| Example 14 | 1.6 | 2.8 | 3.0 | 93 | 4.0 | 43 | Three-Dimensional | 1 | 7.5 | 2 |
| Example 15 | 1.6 | 2.9 | 3.1 | 24 | 4.0 | 48 | Three-Dimensional | 1 | 7.7 | 1 |
| Example 16 | 1.6 | 2.9 | 3.2 | 91 | 4.0 | 50 | Three-Dimensional | 2 | 7.8 | 1 |
| Example 17 | 1.6 | 3.0 | 3.3 | 91 | 3.8 | 58 | Three-Dimensional | 1 | 7.5 | 1 |
| Example 18 | 1.6 | 2.9 | 3.1 | 94 | 3.8 | 54 | Three-Dimensional | 1 | 7.0 | 1 |
| Comparative Example 10 | 1.6 | 1.8 | 2.0 | 90 | 2.4 | 90 | Three-Dimensional | 3 | 4.0 | 3 |
| Comparative Example 11 | 1.6 | 2.2 | 2.4 | 92 | 2.6 | 78 | Three-Dimensional | 3 | 3.5 | 3 |
| Comparative Example 12 | 1.6 | 2.6 | 2.9 | 91 | 3.6 | 67 | Two-Dimensional | 3 | 3.3 | 3 |
| Comparative Example 13 | 1.6 | 2.6 | 3.2 | 81 | 2.8 | 74 | Three-Dimensional | 3 | 3.6 | 3 |
| Comparative Example 14 | 1.6 | 2.5 | 3.5 | 71 | 2.6 | 81 | Two-Dimensional | 4 | 3.5 | 3 4 |
| Comparative Example 15* | 1.6 | 3.5 | 3.8 | 92 | 3.9 | 38 | Two-Dimensional | 4 | 3.1 | — |
| Example 19* | 1.6 | 3.0 | 3.3 | 91 | 3.8 | 48 | Three-Dimensional | 4 | 6.1 | 4 |
| Example 20 | 1.6 | 3.0 | 3.3 | 91 | 3.9 | 58 | Three-Dimensional | 2 | 7.0 | |
| Example 21 | 1.6 | 2.9 | 3.2 | 91 | 3.8 | 56 | Three-Dimensional | 2 | 6.2 | 2 |
| Comparative Example 16 | 1.6 | 2.9 | 3.2 | 91 | 3.7 | 60 | Two-Dimensional | 3 | 5.0 | 4 |
| Example 22 | 1.6 | 2.9 | 3.1 | 94 | 3.9 | 42 | Three- | 1 | 7.0 | 1 |

TABLE 3-continued

| | | | | | | |
|---|---|---|---|---|---|---|
| | | | | Dimensional | | |

From Examples 13 to 22 and Comparative Examples 6 to 9 specified in Table 3, it is found that when the two core components have the Q values within the range defined by the present invention, the development of three-dimensional crimps are condiderably noticeable and the bulkiness of the obtained nonwoven fabrics are excellent, if other requirements satisfy the present invention. From Examples 13 and 14, it is understood that when affinity-reducing agent such as polysiloxane is added to the raw material polymer in the manufacture, composite fibers by far better aggregatability, i.e. formability of nodular aggregates, can be obtained than those obtained otherwise. From the comparison of Examples 19 to 21 with Comparative Examples 10 to 16, it is found that the composite fibers obtained by the present method are excellent in the development of three-dimensional crimps, and high in the bulkiness of the obtaine nonwoven fabrics; however, when the proportion of the sheath, the application of the heat treatment of nonstretched yarns, the stretching temperature and draw ratio depart from the presently defined range, the composite fibers are poor in the aforesaid properties even through the same starting polymers are used. From the comparison of Example 20 and 21 with Example 19 in particular, it is found that, the composite fibers obtained by applying the heat treatment to be effected prior to stretching of the composite nonstretched yarns are more excellent in the aggregatability and then in the touch or feeling of the resulting nonwoven fabrics, than ones abtained without said heat treatment. Accordingly, it is found that the heat treatment of the composite nonstretched yarns takes great part in the aggregatability.

Use Tests

Test Group 1

The heat-adhesive composite fiber (2.9 d/f) obtained in Example 3 was cut to a length of 64 mm, and was mixed with rayon of 2d×51 mm in the proportions set forth in Table 4. A nonwoven fabric of about 100 g/m$^2$ was made substantially according to the procedures for testing the aforesaid "Bulkiness of Nonwoven Fabric", and was tested in respect of its buliness and measured in terms of its strength and elongation.

Strength and Elongation of Nonwoven Fabric:

Five test pieces of 20 cm×5 cm are cut out of the nonwoven fabric in such a manner that their sides of 20 cm lie along the flow direction on a carding machine. The breaking strength and elongation of the five test pieces are found with a tensile strength tester at a grab space of 100 mm and a drawing speed of 100 mm/min., and the measurements were averaged.

The results are given in Table 4.

TABLE 4

| Use Test No. | Mixing Ratio (weight %) Composite Fibers | Rayon | Weight (g/m$^2$) | Bulkiness (mm) | Strenght (kg/5 cm) | Elongation (%) |
|---|---|---|---|---|---|---|
| 1 | 10 | 90 | 99 | 3.7 | 0.25 | 185 |
| 2 | 20 | 80 | 97 | 3.9 | 0.36 | 136 |
| 3 | 30 | 70 | 102 | 5.9 | 1.02 | 92 |
| 4 | 40 | 60 | 98 | 6.4 | 2.70 | 94 |
| 5 | 60 | 40 | 100 | 6.8 | 3.28 | 83 |
| 6 | 80 | 20 | 104 | 7.1 | 5.47 | 76 |
| 7 | 100 | 0 | 98 | 7.6 | 7.96 | 66 |

From the comparison of Use Test Nos. 1 to 2 with Nos. 3 to 7 given in Table 4, it is found that the nonwoven fabrics which are formed from the mixtures of the heat-adhesive composite fibers according to the present invention with other fibers such as rayon are excellent in the bulkiness and strength, when said composite fibers are used at least 30% by weight.

Test Group 2

Except that the heat-adhesive composite fibers obtained in Example 16 were used instead of one obtained in Example 3, Test Group 1 was repeated to make nonwoven fabrics, which were then tested in respect of the bulkiness and touch or feeling and measured in terms of the strength and elongation. The reference nonwoven fabric for the estimation of touch or feeling was obtained from 30% by weight of the composite fibers obtained in Comparison Example 15 and 70 by weight of rayon in a similar manner.

Procedures of Testing (except for the foregoing)

Touch or Feeling of Nonwoven Fabric:

The same as in Examples 13 to 22.

The results are given in Table 5.

TABLE 5

| Use Test No. | Mixing Ratio (weight %) Composite Fibers | Rayon | Weight (g/m$^2$) | Touch or Feeling | Bulkiness (mm) | Strength (kg/5 cm) | Elongation (%) |
|---|---|---|---|---|---|---|---|
| 8 | 10 | 90 | 102 | 4 | 3.8 | 0.21 | 180 |
| 9 | 20 | 80 | 100 | 3 | 3.9 | 0.32 | 120 |
| 10 | 30 | 70 | 98 | 2 | 5.8 | 1.01 | 90 |
| 11 | 40 | 60 | 100 | 2 | 6.3 | 2.58 | 90 |
| 12 | 60 | 40 | 98 | 2 | 6.8 | 3.04 | 84 |
| 13 | 80 | 20 | 101 | 1 | 7.1 | 5.44 | 75 |
| 14 | 100 | 0 | 100 | 1 | 7.7 | 7.76 | 68 |
| Standard Reference Nonwoven Fabric | 30 | 70 | 98 | — | 3.4 | 1.08 | 94 |

Testing Procedures

Bulkiness of Nonwoven Fabric:

The same procedures as in Examples 1 to 12.

From the comparison of Use Test Nos. 8 to 9 with Nos. 10 to 14 given in Table 5, it is found that the nonwoven fabrics which are formed from the mixtures of the heat-adhesive compsite fibers according to the present invention with other fibers such as rayon are excellent in the touch or feeling, bulkiness and strength, when said composite fibers are used at least 30% by weight.

What is claimed is:

1. A heat-adhesive composite fiber comprising a core portion and a sheath portion, (A) said core portion being of the side-by-side type composite structure comprising two core components made of different polypropylene base polymers present in a composite ratio of 1:2 to 2:1, one of said core components having a Q value, expressed in terms of weight-average molecular weight/number-average molecular weight, equal to or higher than 6, and the other core component having a Q value equal to or lower than 5, and (B) said sheath portion satisfying at least the following requirements (i) and (ii);

(i) said sheath portion comprising a sheath component of a polyethylene base polymer having a melting point lower by at least 20° C. than the lower of the two melting points of said two core components;

(ii) said sheath portion covering said core portion in a proportion of 25 to 55% by weight based on the total weight of said sheath portion and said core portion.

2. A heat-adhesive composite fiber as defined in claim 1, wherein said sheath portion satisfies only said requirements (i) and (ii).

3. A heat-adhesive composite fiber as defined in claim 1, wherein said sheath portion satisfies said requirements (i) and (ii), and moreover has a number of aggregatable portions, at least latently releasable, which form many modular aggregates thereon by a heat treatment at a temperature higher than the melting point of said sheath component but lower than the lower one of the two melting points of said two core components.

4. A heat-adhesive composite fiber as defined in claim 1, 2 or 3, wherein said polypropylene base polymer of at least one of said two core components is polypropylene.

5. A heat-adhesive composite fiber as defined in claim 1, 2 or 3, wherein said polypropylene base polymer of at least one of said two core components is a copolymer of propylene with a small amount of an alpha-olefin other than propylene.

6. A heat-adhesive composite fiber as defined in claim 1, 2, or 3, wherein said polyethylene base polymer is polyethylene.

7. A heat-adhesive component fiber as defined in claim 1, 2 or 3, wherein said polyethylene base polymer is an ethylene-vinyl acetate copolymer having an ethylene content of 98 to 60% by weight.

* * * * *